US009828823B2

(12) United States Patent
Tan

(10) Patent No.: US 9,828,823 B2
(45) Date of Patent: Nov. 28, 2017

(54) ROD HANG-OFF SYSTEM

(71) Applicant: Cameron International Corporation, Houston, TX (US)

(72) Inventor: Teng Oon Tan, Singapore (SG)

(73) Assignee: Cameron International Corporation, Houston, TX (US)

( * ) Notice: Subject to any disclaimer, the term of this patent is extended or adjusted under 35 U.S.C. 154(b) by 653 days.

(21) Appl. No.: 14/242,541

(22) Filed: Apr. 1, 2014

(65) Prior Publication Data

US 2015/0275610 A1 Oct. 1, 2015

(51) Int. Cl.

| | |
|---|---|
| ***E21B 33/04*** | (2006.01) |
| ***E21B 33/06*** | (2006.01) |
| ***E21B 43/12*** | (2006.01) |
| ***E21B 19/02*** | (2006.01) |

(52) U.S. Cl.

CPC ..... *E21B 33/04* (2013.01); *E21B 19/02* (2013.01); *E21B 33/0422* (2013.01); *E21B 33/062* (2013.01); *E21B 43/127* (2013.01)

(58) Field of Classification Search

CPC .. E21B 17/1007; E21B 17/1071; E21B 33/04; E21B 33/0422; E21B 33/062

See application file for complete search history.

(56) References Cited

U.S. PATENT DOCUMENTS

| | | | | |
|---|---|---|---|---|
| 3,151,892 | A * | 10/1964 | Word, Jr. | E21B 33/047 285/123.2 |
| 4,022,281 | A * | 5/1977 | Pennock | E21B 23/02 166/341 |
| 4,694,910 | A | 9/1987 | Towner et al. | |
| 4,825,948 | A * | 5/1989 | Carnahan | E21B 33/062 166/277 |
| 4,930,745 | A * | 6/1990 | Granger | E21B 33/062 251/1.1 |
| 5,044,602 | A * | 9/1991 | Heinonen | E21B 33/06 166/84.1 |
| 5,730,218 | A | 3/1998 | Swagerty et al. | |
| 6,223,819 | B1 | 5/2001 | Heinonen | |
| 6,474,412 | B2 | 11/2002 | Hamilton et al. | |
| 7,367,396 | B2 | 5/2008 | Springett et al. | |
| 2011/0198072 | A1 * | 8/2011 | Cote | E21B 33/03 166/75.11 |
| 2013/0126763 | A1 | 5/2013 | Guo et al. | |
| 2013/0181147 | A1 | 7/2013 | Wright et al. | |
| 2016/0215575 | A1 * | 7/2016 | Robison | E21B 33/062 |

* cited by examiner

*Primary Examiner* — David J Bagnell
*Assistant Examiner* — Tara E Schimpf
(74) *Attorney, Agent, or Firm* — Eubanks PLLC

(57) ABSTRACT

A hang-off system for suspending a rod string within a well is provided. In one embodiment, such a system includes a hang-off ram of a blowout preventer and a hang-off sub sized to fit within a bore of the blowout preventer. The hang-off ram and the hang-off sub have complementary surfaces that enable the hang-off ram to engage the hang-off sub within the blowout preventer to facilitate suspension of a sucker-rod string in a well from the hang-off sub. Additional systems, devices, and methods are also disclosed.

15 Claims, 9 Drawing Sheets

ROD HANG-OFF SYSTEM

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Further, such systems generally include wellhead assemblies mounted on wells through which resources are accessed or extracted. These wellhead assemblies can include a wide variety of components, such as various spools, casings, valves, pumps, fluid conduits, and the like, that facilitate drilling or extraction operations. More particularly, wellhead assemblies often include a blowout preventer, such as a ram-type blowout preventer that uses one or more pairs of opposing rams to restrict flow of fluid through the blowout preventer. The rams typically include main bodies (or ram blocks) that receive sealing elements (or ram packers) that press together when a pair of opposing rams close against one another.

Various techniques are used to facilitate production from wells. For example, artificial lift can be used to pump fluids up wells to the surface. In accordance with one artificial lift technique, sucker-rod strings extending from the surface down into wells are used to drive operation of downhole pumps for pumping fluids to the surface. Additionally, enhanced oil recovery techniques (e.g., steam injection) can also be used to promote well production.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to suspending a sucker-rod string within a well. In some embodiments, a hang-off sub is coupled to a sucker-rod string. The hang-off sub can be positioned within a blowout preventer and aligned to allow hang-off rams of the blowout preventer to engage the hang-off sub. The engaged hang-off rams support the hang-off sub, allowing the sucker-rod string to be suspended within the well from the hang-off sub. In at least one embodiment, the sucker-rod string is threaded to a lower end of the hang-off sub. A crossover can be threaded to an upper end of the hang-off sub to facilitate installation and removal of the hang-off sub from the blowout preventer while attached to the sucker-rod string. With the sucker-rod string suspended in the well from the hang-off sub, the well can be shut in and steam can be injected into the well without using sealing rams or a stuffing box.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
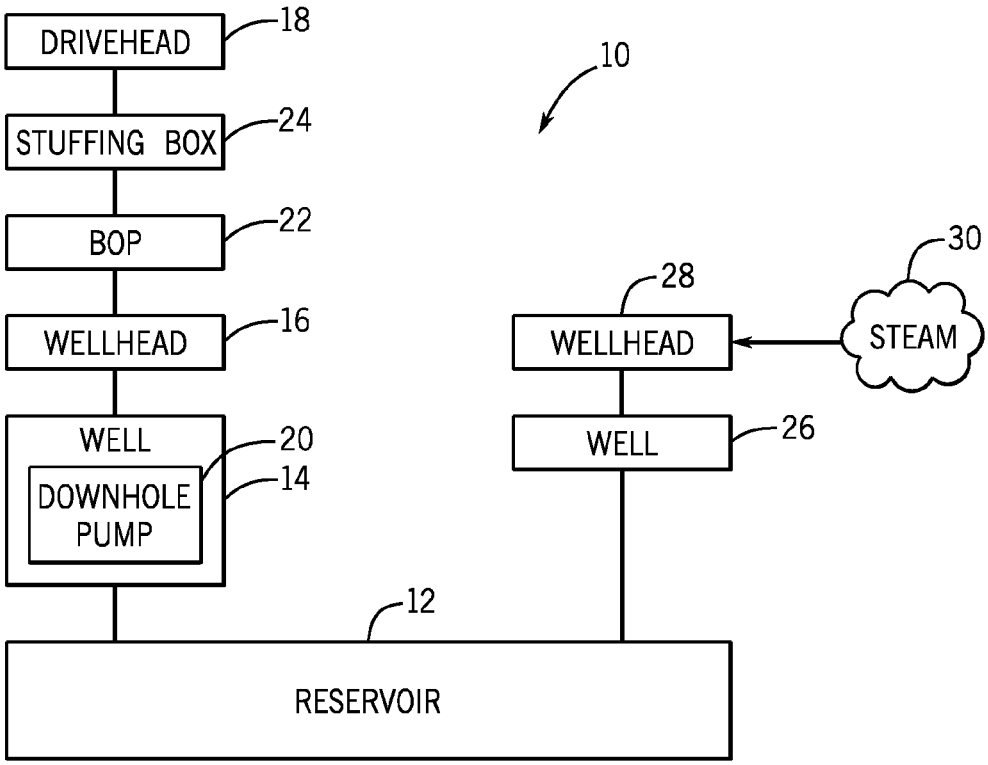
FIG. 1 generally depicts a production system having a blowout preventer installed on a wellhead in accordance with one embodiment of the present disclosure.

Turning now to the present figures, a system 10 including a blowout preventer is illustrated in FIG. 1 in accordance with one embodiment. Notably, the system 10 is a production system that facilitates extraction of a resource, such as oil, from a reservoir 12 through a well 14 and a wellhead 16. In one embodiment, the wellhead 16 includes a casing head and a tubing head. But the components of the wellhead 16 can differ between applications, and such equipment could include various casing heads, tubing heads, pumping tees, and pressure gauges, to name only a few possibilities.

Production systems sometimes rely on artificial lift to help raise fluid from the reservoir 12 to the surface. As here depicted, such artificial lift is provided by a drivehead 18 that controls operation of a downhole pump 20. By way of example, the drivehead 18 can cooperate with a prime mover (e.g., an engine or motor) to impart movement to a component of the downhole pump 20 via a rod string. The drivehead 18 can include a horsehead on a walking beam of a beam-pumping unit; the horsehead can be connected to the rod string with a bridle to enable reciprocal motion of the walking beam and horsehead to drive the rod string up and down within the well. It is noted, however, that other arrangements for providing artificial lift could be used as well.

The system 10 also includes a blowout preventer 22 and a stuffing box 24 coupled to the wellhead 16. The blowout preventer 22 can include one or more elements, such as rams, operable to seal a bore through the blowout preventer and inhibit flow of wellbore fluid through the bore. The blowout preventer 22 can be coupled directly to the wellhead 16 or indirectly via one or more other components, such as an adapter spool. As noted above, the drivehead 18 can be connected to the downhole pump 20 with a rod string. In at least some embodiments, such a rod string extends through a bore of the blowout preventer 22, which includes rams that can be closed about the rod string inside the bore. The stuffing box 24 includes one or more seals that engage the rod string and allow it to move while inhibiting leaking of fluid along the rod string. In at least some embodiments, the rod string includes a sucker-rod string with a polished rod that is positioned within the blowout preventer 22 and the stuffing box 24.

A second well 26 and wellhead 28 are depicted in FIG. 1. Although not shown in the present figure, a blowout preventer can be provided on the wellhead 28. The second well 26 can be drilled near the first well 14 within the reservoir 12 and facilitates steam flooding of the reservoir. In a steam flooding process, steam 30 can be pumped down the well 26 to heat the reservoir 12. As steam 30 cools in the reservoir, it condenses into water. This water is pushed by further steam 30 injected behind it, driving oil in the reservoir 12 into the well 14. Further, the steam 30 raises the temperature and viscosity of the oil, which further enhances recovery. The fluids can then be pumped to the surface via the downhole pump 20. In some other instances, cyclic steam stimulation can be used to increase production from the well 14. For example, steam can be pumped down the well 14, which can then be shut in to allow the steam to heat the reservoir and increase oil viscosity. After this shut-in period, the oil may be pumped to the surface via the same well 14.

In some previous instances, sealing rams of a blowout preventer would be closed to seal about the rod string during steam injection to inhibit flow of high-temperature fluids (e.g., the steam) up through the blowout preventer to an attached stuffing box having non-metallic seals that could be damaged by excessive heat. The high temperature fluids, however, would degrade the seals of such sealing rams and compromise their ability to seal about the rod string. The sealing rams would then be changed out by disconnecting the rod string from a surface pumping apparatus (e.g., a beam-pumping unit) and pulling the entire rod string from the well with a rig. Once the rod string was pulled from the well, a barrier could be set in the wellhead (e.g., in a tubing hanger) to secure the well and the sealing rams of the blowout preventer could then be replaced. After that, the barrier could be removed from the wellhead, the entire rod string could be run into the well again using a rig, and the rod string could then be reconnected to the surface pumping apparatus.

Rather than using sealing rams in a blowout preventer to inhibit flow to a stuffing box, certain embodiments of the present technique include a rod hang-off system for suspending a rod string within a well. In at least some instances, the rod hang-off system enables steam injection operations at the well without sealing rams or a stuffing box (which can be removed before steam injection operations and then reattached to resume normal operation), thus avoiding possible degradation of seals of the rams or stuffing box from high temperatures during the steam injection operations. Further, the presently disclosed techniques can avoid the above-described need to remove the rod string from the well and then re-run the rod string into the well during replacement of sealing rams, thus providing rig-time savings and reducing operating costs.

Figure 2:
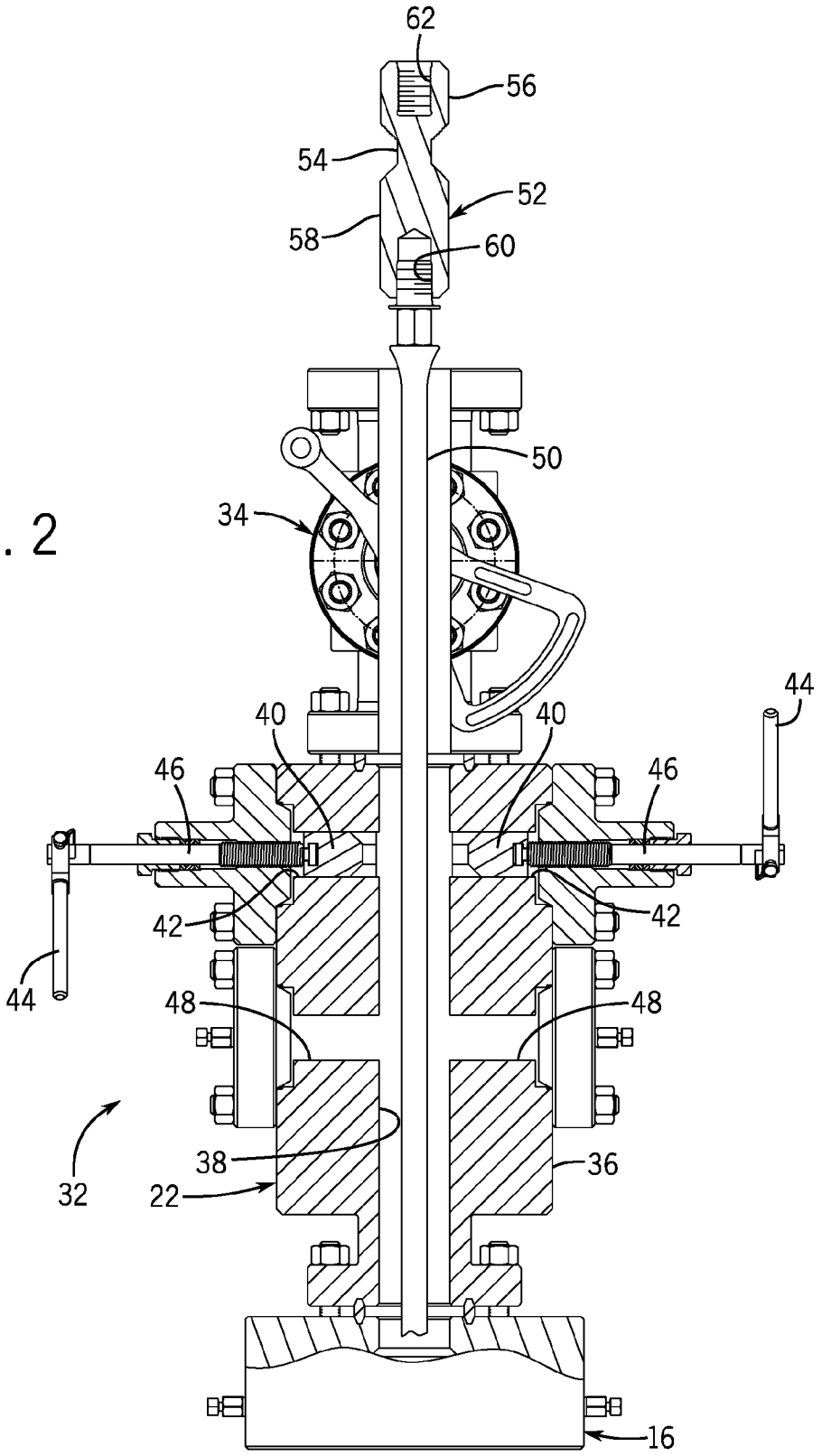
FIG. 2 depicts a wellhead assembly having a blowout preventer with hang-off rams for engaging a hang-off sub of a rod string in accordance with one embodiment.

One example of a wellhead assembly 32 using such a hang-off technique is depicted in FIG. 2. In this embodiment, the blowout preventer 22 is coupled to the wellhead 16 (e.g., to a tubing head) installed at the well 14. A valve 34 is attached to the upper end of the blowout preventer 22, though the valve 34 can be omitted in other embodiments. The blowout preventer 22 includes a hollow body 36 with a bore 38. Rams 40 are provided within ram cavities 42 and can be pushed into or pulled out of the bore 38 to engage a hang-off sub 52, as described in greater detail below. In this depicted embodiment, the rams 40 can be manually actuated by turning handles 44. More specifically, the handles 44 are coupled to the rams 40 by rods 46 threaded through bonnets attached to the body 36 of the blowout preventer 22. Rotation of the handles 44 in one direction causes the rods 46 to extend the rams 40 into the bore 38, while rotation in the other direction causes the rods 46 to retract the rams 40. In other embodiments, the rams 40 can be actuated in some other manner, such as through hydraulic actuation. The blowout preventer 22 is depicted in FIG. 2 as a double blowout preventer having additional ram cavities 48 for receiving an additional set of rams, though the blowout preventer 22 could have other configurations.

In FIG. 2, a hang-off sub 52 is shown coupled to a sucker-rod string 50 inserted through the wellhead assembly 32. It will be appreciated that the sucker-rod string 50 can extend down into the well 14 and be connected to the downhole pump 20. The hang-off sub 52 and the hang-off rams 40 have complementary surfaces that allow the hang-off ram to engage the hang-off sub 52 and support the weight of the rod string (i.e., here the sucker-rod string 50 and the connected hang-off sub 52). This allows the rod string to be suspended from the hang-off rams 40. During operation of the downhole pump 20, a polished rod can be connected to the upper end of the sucker-rod string 50, as generally described above. To prepare to suspend the sucker-rod string from the hang-off rams 40, the polished rod may be pulled out of the upper end of the wellhead assembly 32 and disconnected from the sucker-rod string 50, allowing the hang-off sub 52 to be attached to the sucker-rod string 50 in place of the polished rod. Of course, the hang-off sub 52 could also be installed to the top of the sucker-rod string 50 before a polished rod has been connected (e.g., during initial running of the sucker-rod string 50 into the well 14).

Figure 3:
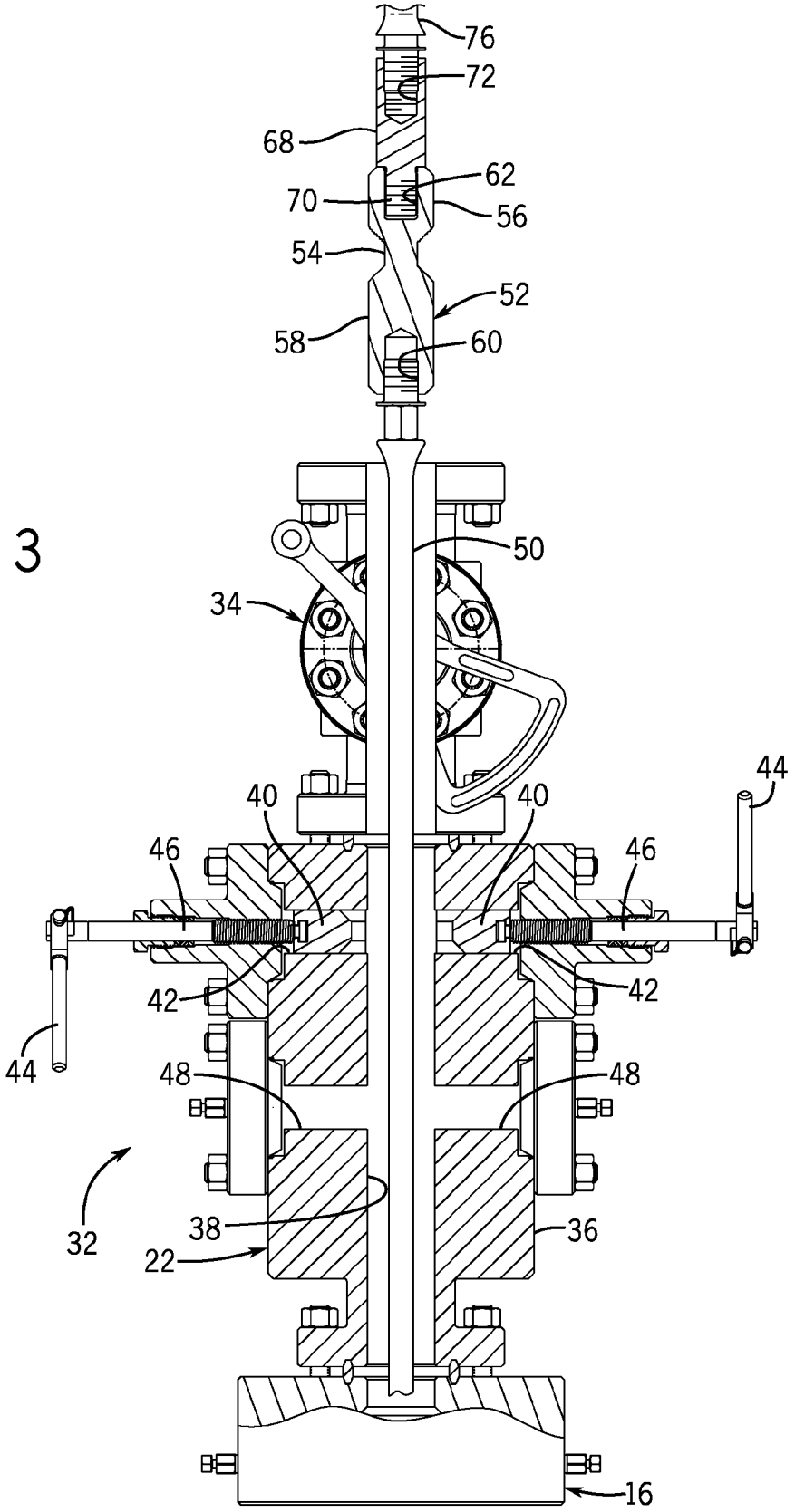
FIG. 3 generally depicts a crossover coupled to the hang-off sub of FIG. 2 in accordance with one embodiment.

In the presently depicted embodiment, the hang-off sub 52 includes a recess 54 between an upper portion 56 and a lower portion 58 of the hang-off sub 52. The recess 54 is provided as a circumferential groove in some embodiments (as shown best in FIG. 5), but the recess 54 could be provided in other forms, including multiple recesses on opposite sides of the hang-off sub 52 to receive the rams 40. The lower portion 58 of the hang-off sub 52 includes a threaded recess 60 for receiving a threaded pin end of a sucker-rod joint of the sucker-rod string 50. The upper portion 56 of the hang-off sub 52 similarly includes a threaded recess 62 for connection to a threaded pin end of another component, such as a crossover 68 depicted in FIG. 3 in accordance with one embodiment.

The crossover 68 is shown as having a threaded pin end 70 connected to the threaded recess 62 of the hang-off sub 52. The crossover 68 also has a box end with a threaded recess 72 to enable connection to a sucker-rod joint 76, a polished rod, or some other component. The threaded recess 62 and the threaded pin end 70 of the crossover 68 are configured differently than the threaded recess 60 and threaded connection ends of sucker rods of the string 50 in at least some embodiments. For example, the connection between the threaded recess 62 and the threaded pin end 70 can be configured to have a lower break-out torque than that of the threaded recess 60 and a sucker rod of the string 50 (as well as that of the threaded recess 72 and threaded end of the sucker rod joint 76), thus facilitating later disconnection of the crossover 68 from the hang-off sub 52. In some embodiments, the threaded pin end 70 includes low-torque threads and the threaded recess 62 and threaded pin end 70 include mating threads having a thread pitch greater than that of the mating threads of the threaded recess 60 and the sucker rods of the string 50. But the differences in break-out torque could be provided in other suitable manners.

Figure 4:
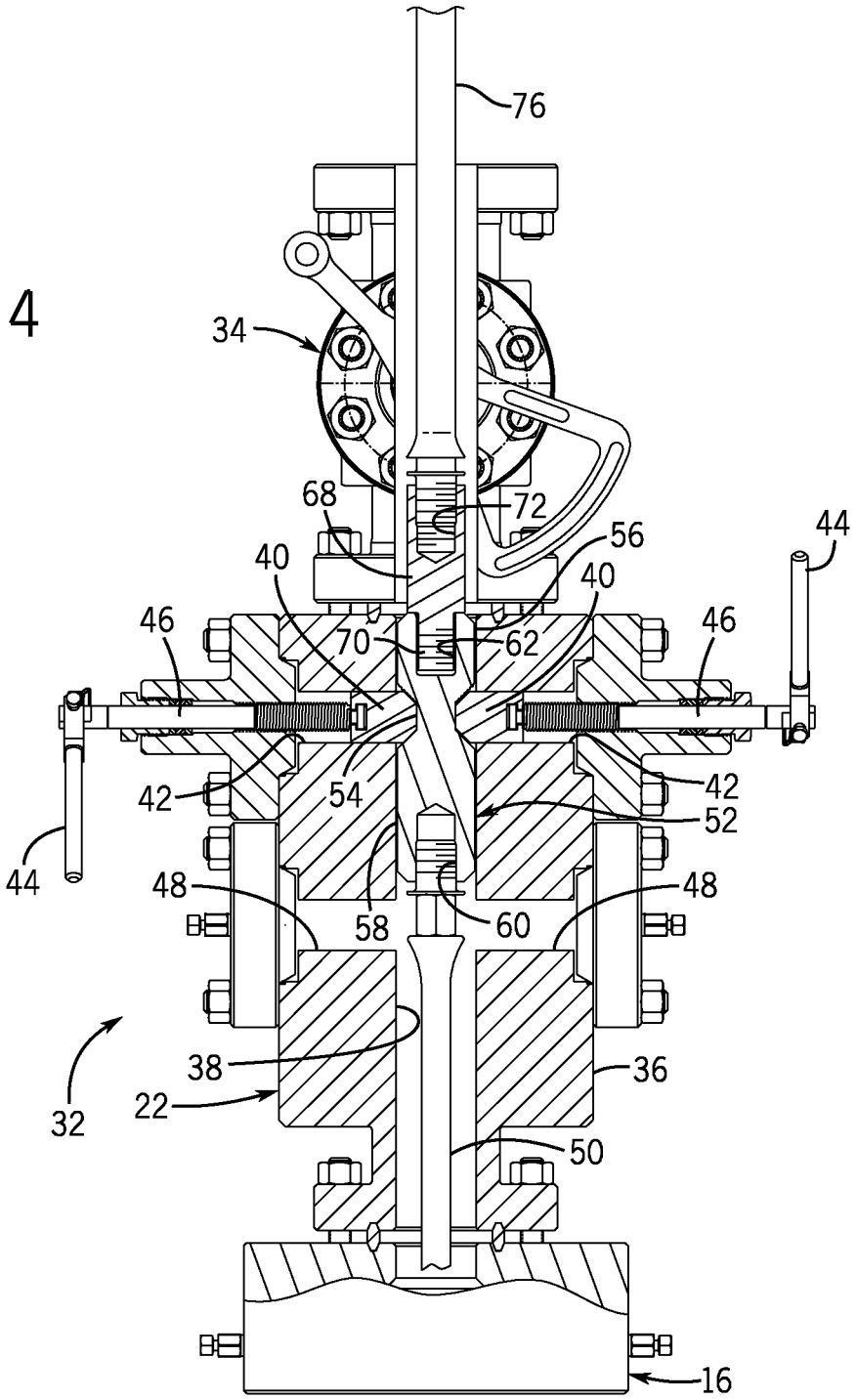
FIG. 4 illustrates the hang-off sub aligned with and engaged by the hang-off rams to suspend a sucker-rod string in a well from the wellhead assembly in accordance with one embodiment.

The rod string can then be lowered in the wellhead assembly 32 to align the recess 54 of the hang-off sub 52 with the hang-off rams 40, which can then be extended into the recess 54 as generally depicted in FIG. 4. In embodiments without the valve 34 or other components installed on the top of the blowout preventer 22, the position of the hang-off 52 with respect to the rams 40 may be visually determined during alignment. In other embodiments, measurements of the wellhead assembly above the rams 40 and of the crossover 68 and sucker-rod joint 76 can be used to facilitate alignment of the hang-off sub 52 with the rams 40. Further, the amount by which the rods 46 extend outward from the blowout preventer 22 can be used to verify whether the rams 40 have engaged the recess 54.

Figure 5:
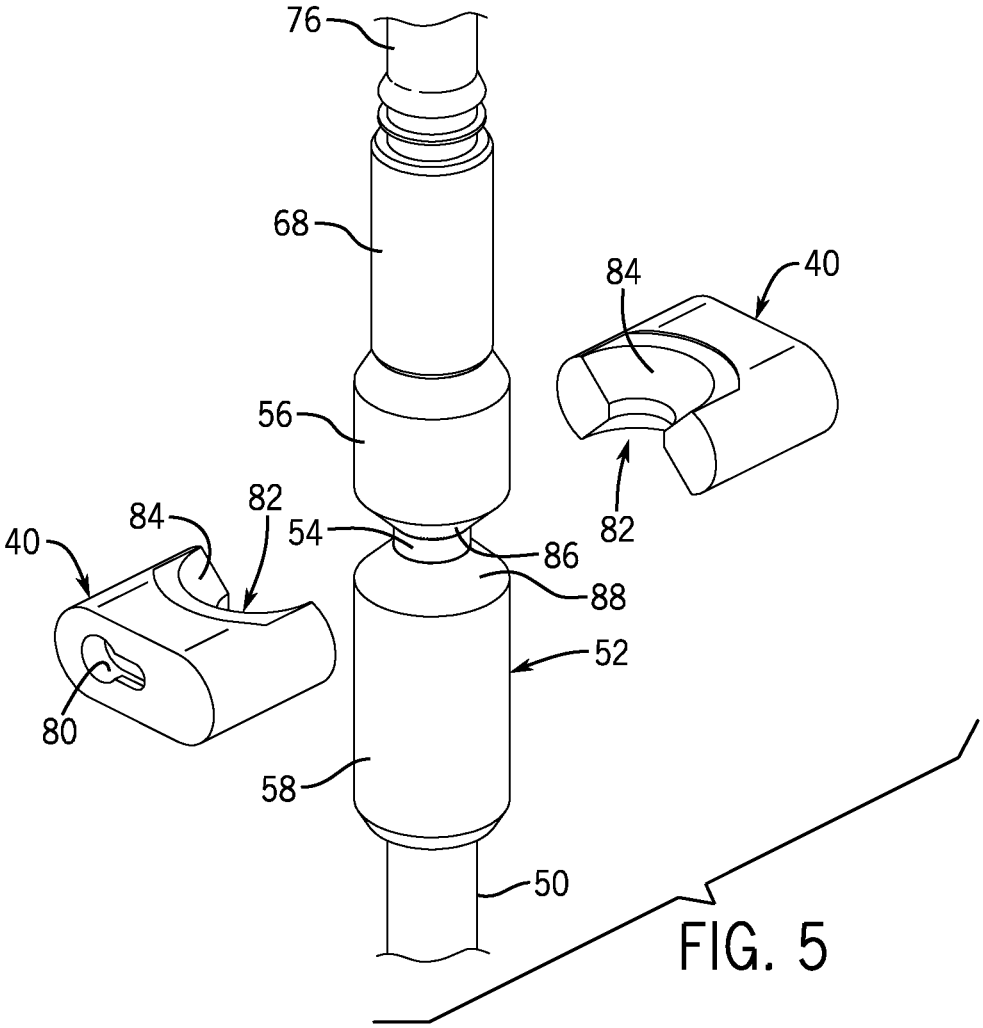
FIG. 5 is a perspective view of the hang-off rams and a portion of the rod string, including the hang-off sub, in accordance with one embodiment.

The hang-off rams 40 and the hang-off sub 52 can have any suitable configuration having complementary surfaces that enable suspension of the sucker-rod string 50 by these components. By way of example, the hang-off rams 40 and the hang-off sub 52 are depicted in FIG. 5 in accordance with one embodiment. Each of the hang-off rams 40 can include one end having a slot 80 for receiving a ram button of a rod 46 and an opposite end 82 for engaging the recess 54 of the hang-off sub 52. As shown here, the ends 82 of the rams 40 have semi-circular openings for engaging the hang-off sub 52 at the recess 54. The rams 40 include upper tapered surfaces 84 that complement tapered surface 86 of the recess 54. When the rams 40 are closed about the hang-off sub 52, engagement of the tapered surfaces 84 and 86 allow the hang-off rams 40 to support the weight of the rod string. In at least some embodiments, such as that depicted in FIG. 5, the hang-off sub 52 also includes a tapered surface 88 opposite the surface 86. Just as engagement of the tapered surfaces 84 and 86 inhibits downward axial movement of the hang-off sub 52 and its attached sucker-rod string 50, the rams 40 and the tapered surface 88 inhibit upward axial movement of the hang-off sub 52. Further, it is noted that while the hang-off sub 52 is described above as having tapered surfaces 86 and 88, the surfaces 86 and 88 could instead be provided without the taper in some embodiments. Similarly, corresponding surfaces of rams 40 could also be provided without the taper.

Figure 6:
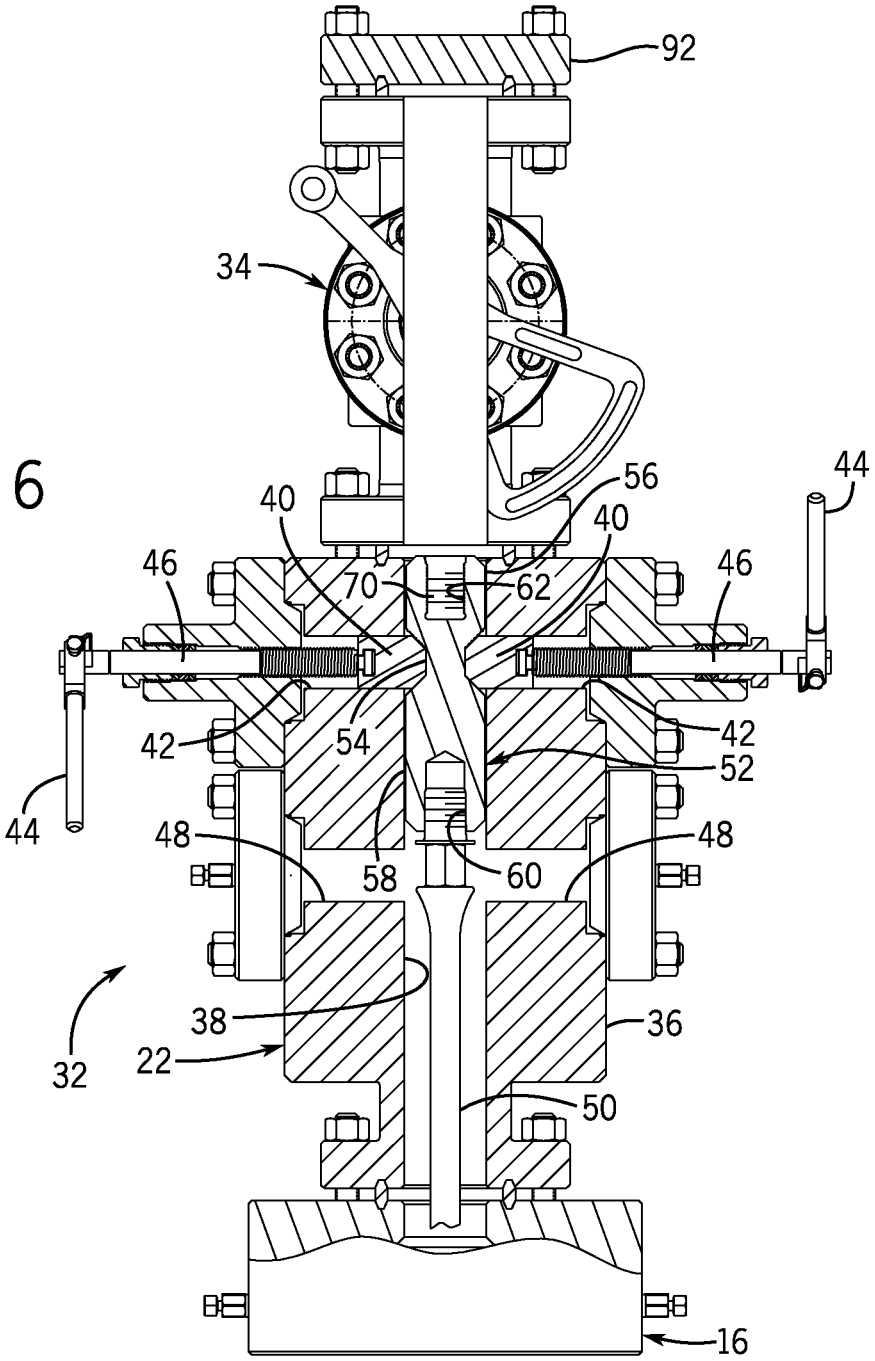
FIGS. 6 and 7 generally depict the use of a blind flange to shut-in the well for steam injection operations in accordance with certain embodiments.
Figure 7:
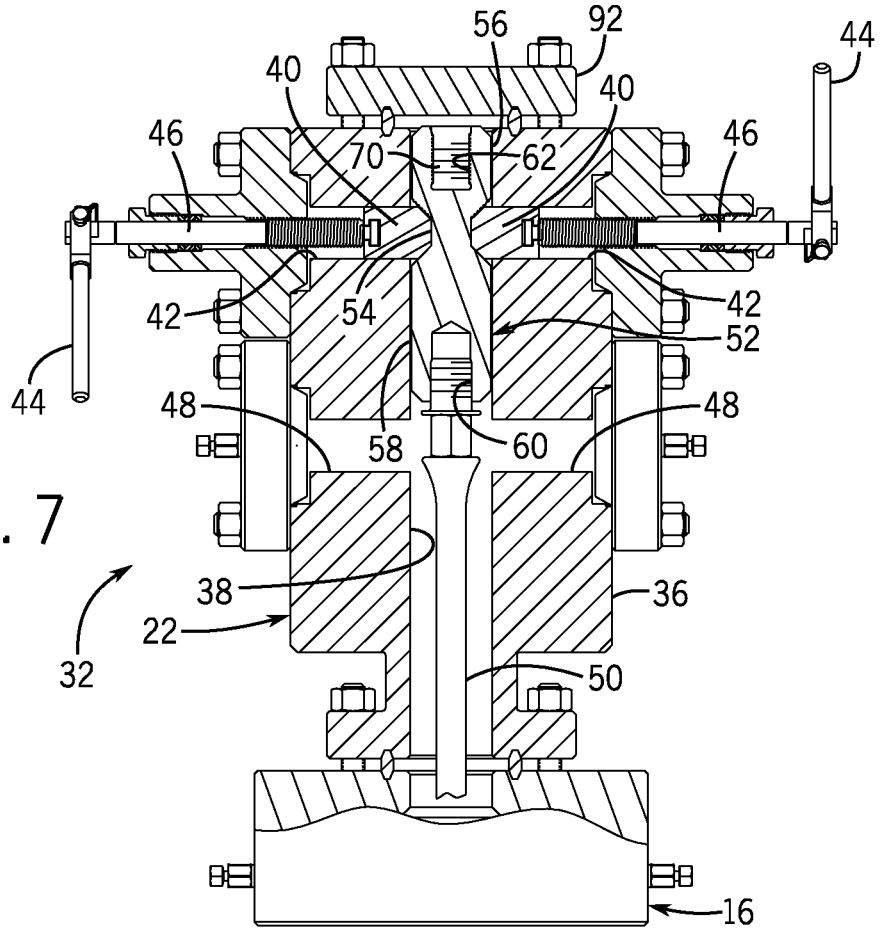

Once the hang-off rams 40 are closed into the recess 54, the sucker-rod joint 76 can be rotated to unthread the crossover 68 from the hang-off sub 52, leaving the sucker-rod string 50 and the hang-off sub 52 hanging from the hang-off rams 40. The sucker-rod joint 76 and the crossover 68 can then be removed and the wellhead assembly 32 can be sealed. For instance, a blind flange 92 can be connected to the top of the valve 34 with a metal sealing gasket or with some other seal, as shown in FIG. 6. In other embodiments, such as that shown in FIG. 7, the blind flange 92 is connected directly to the top of the blowout preventer 22. With the wellhead assembly 32 sealed, steam can be injected into the well to enhance future production.

Figure 8:
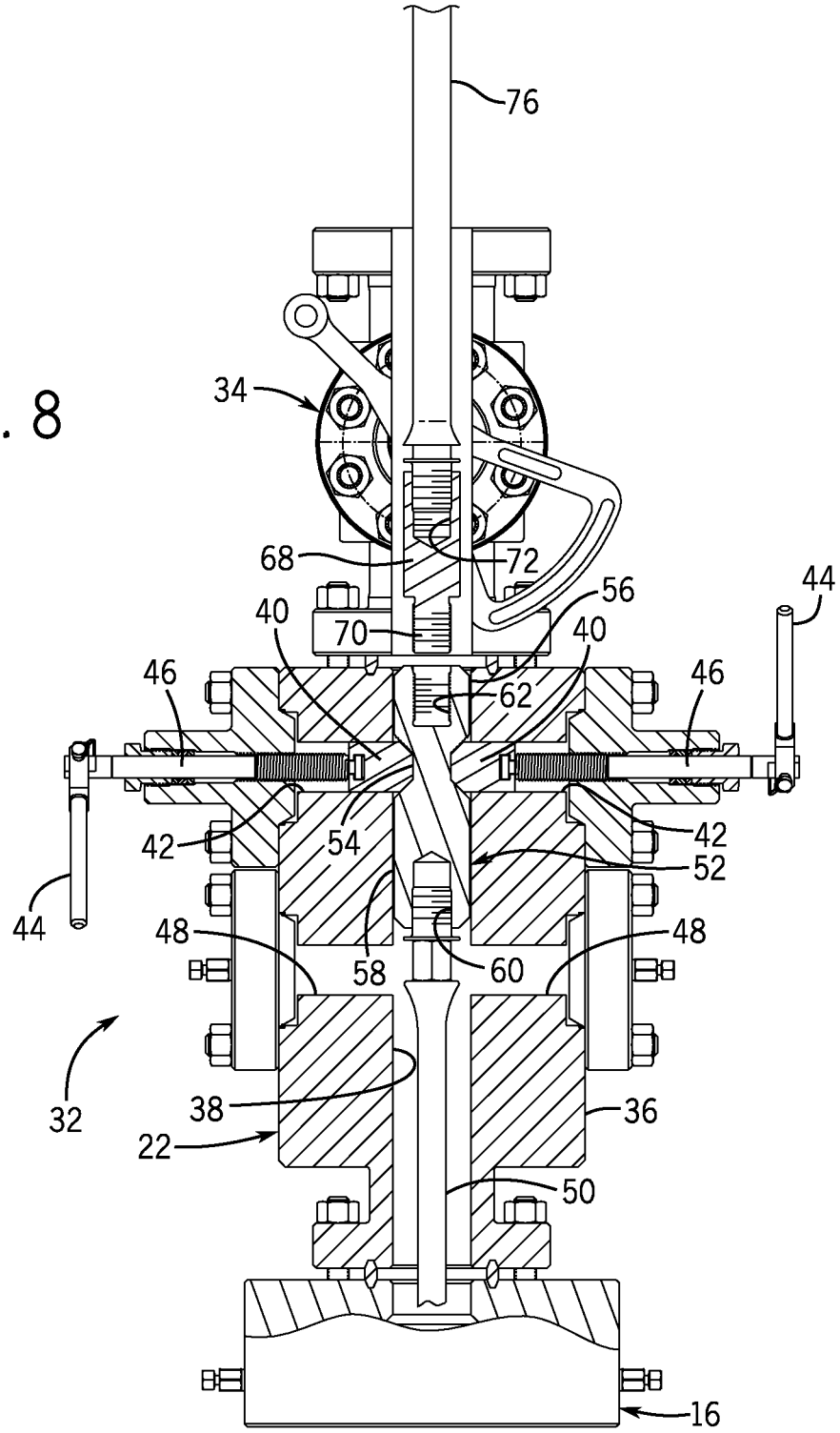
FIG. 8 shows the crossover of FIG. 3 as it is lowered into the wellhead assembly to facilitate retrieval of the hang-off sub from the blowout preventer in accordance with one embodiment.
Figure 9:
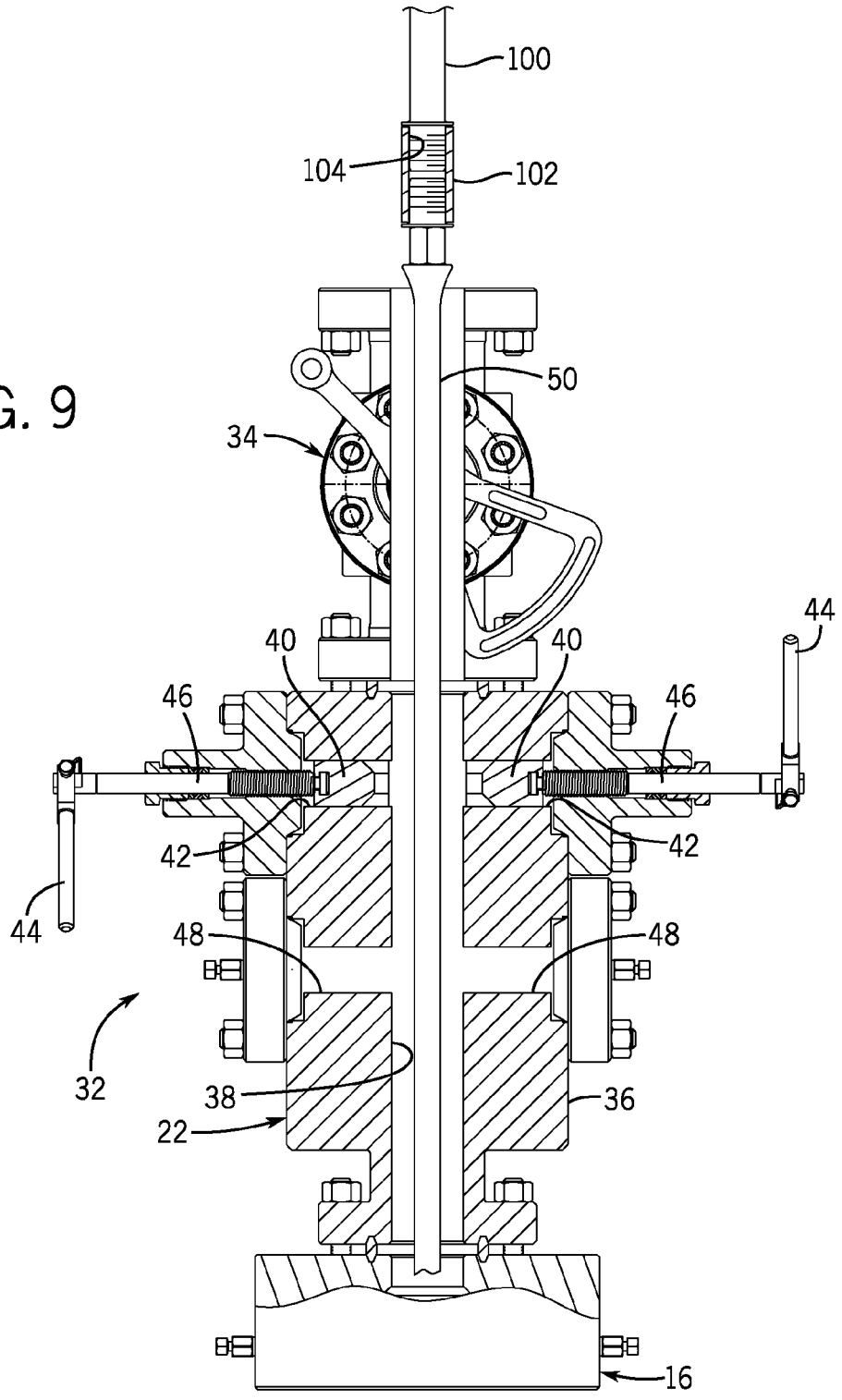
FIG. 9 depicts a polished rod connected to the sucker-rod string in place of the hang-off sub in accordance with one embodiment.

After steam injection operations are completed, the well 14 will typically flow unassisted for some period of time. Once the well 14 no longer flows unassisted, the blind flange 92 can be removed from the wellhead assembly 32 and the crossover 68 can be lowered, as generally shown in FIG. 8, toward the hang-off sub 52. The sucker-rod joint 76 can be rotated to thread the pin end 70 of the crossover 68 to the threaded recess 62 of the hang-off sub 52. The hang-off rams 40 can then be opened to release the hang-off sub 52, which can be pulled out of the blowout preventer 22 with the sucker-rod joint 76 and the crossover 68. The hang-off sub 52 can then be disconnected from the top of the sucker-rod string 50, allowing a polished rod 100 to be connected to the sucker-rod string 50. As depicted in FIG. 9, the polished rod 100 can be connected to the sucker-rod string 50 with a coupling 102, which has a threaded bore 104 for receiving threaded ends of the polished rod 100 and the uppermost sucker rod of the sucker-rod string 50. The polished rod 100 can be connected to the drivehead 18 (e.g., of a beam-pumping unit or other pumping assembly) and production from the well may then be resumed.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a blowout preventer;

a hang-off ram installed in the blowout preventer;

a hang-off sub sized to fit within a bore of the blowout preventer; and a sucker-rod string coupled to the hang-off sub and to a downhole pump;

wherein the hang-off ram and the hang-off sub have complementary surfaces that enable the hang-off ram to engage the hang-off sub within the blowout preventer to facilitate suspension of the sucker-rod string in a well from the hang-off sub, wherein the complementary surfaces include an external recess in the hang-off sub for receiving the hang-off ram.

2. The system of claim 1, wherein the external recess in the hang-off sub includes a circumferential groove about the exterior of the hang-off sub for receiving multiple hang-off rams.

3. The system of claim 1, wherein the external recess in the hang-off sub includes opposing surfaces that complement the hang-off ram and inhibit axial movement of the hang-off sub in two opposite directions when engaged by the hang-off ram within the blowout preventer.

4. The system of claim 1, comprising a crossover to facilitate installation and removal of the hang-off sub from the blowout preventer.

5. The system of claim 4, wherein the crossover includes a threaded pin end to engage a threaded recess of the hang-off sub and a threaded box end to receive a sucker-rod joint or a polished rod.

6. The system of claim 1, wherein the blowout preventer includes a rotatable threaded rod that enables manual actuation of the hang-off ram within the blowout preventer.

7. The system of claim 1, wherein the sucker-rod string is threaded to the hang-off sub.

8. A system comprising:

a wellhead assembly including a blowout preventer installed at a well;

a sucker-rod string positioned within the well and coupled to a downhole pump within the well; and a hang-off sub coupled to the sucker-rod string and supported by the blowout preventer such that the sucker-rod string is suspended from the hang-off sub and such that the hang-off sub is secured in place within the blowout preventer so as to inhibit both upward axial movement and downward axial movement of the hang-off sub and the sucker-rod string.

9. The system of claim 8, wherein the blowout preventer includes a pair of hang-off rams that engage and support the hang-off sub within the blowout preventer.

10. The system of claim 8, wherein the wellhead assembly includes a valve connected to the blowout preventer such that the blowout preventer is positioned between the valve and the wellhead.

11. A method comprising:

closing rams of a blowout preventer of a wellhead assembly to engage a rod string extending into a well from the blowout preventer, wherein closing rams of the blowout preventer of the wellhead assembly to engage the rod string includes closing rams of the blowout preventer of the wellhead assembly to engage an external recess of a hang-off sub of the rod string;

suspending the rod string in the well from the rams such that the rams of the blowout preventer support the weight of the rod string;

sealing the wellhead assembly to enclose an entirety of a top end of the suspended rod string within the wellhead assembly;

unsealing the wellhead assembly to permit access to the top end of the rod string; and coupling a polished rod to the rod string after unsealing the wellhead assembly to permit access to the top end of the rod string.

12. The method of claim 11, comprising coupling the hang-off sub having the external recess to a sucker rod of the rod string.

13. The method of claim 12, comprising, after unsealing the wellhead assembly to permit access to the rod string:

opening the rams of the blowout preventer;

pulling the hang-off sub out of the blowout preventer;

disconnecting the hang-off sub from the sucker rod; and coupling the polished rod to the sucker rod.

14. The method of claim 13, comprising coupling a crossover to the hang-off sub to facilitate pulling of the hang-off sub out of the blowout preventer.

15. The method of claim 11, comprising injecting steam into the well while the rod string is suspended in the well from the rams.

* * * * *